US009974331B2

(12) United States Patent
Portz et al.

(10) Patent No.: US 9,974,331 B2
(45) Date of Patent: May 22, 2018

(54) WATER PIPE HEAD

(75) Inventors: Michael Portz, Erkelenz (DE); Willem Stephanus Malherbe, Amsterdam (NL)

(73) Assignee: The Shisha Company Limited, Road Town (VG)

( * ) Notice: Subject to any disclaimer, the term of this patent is extended or adjusted under 35 U.S.C. 154(b) by 764 days.

(21) Appl. No.: 14/390,749

(22) PCT Filed: Aug. 30, 2012

(86) PCT No.: PCT/EP2012/066846

§ 371 (c)(1),
(2), (4) Date: Oct. 3, 2014

(87) PCT Pub. No.: WO2014/032716

PCT Pub. Date: Mar. 6, 2014

(65) Prior Publication Data

US 2015/0075544 A1 Mar. 19, 2015

(51) Int. Cl.

| | |
|---|---|
| ***A24F 11/00*** | (2006.01) |
| ***A24F 1/14*** | (2006.01) |
| ***A24F 3/00*** | (2006.01) |
| ***A24F 5/00*** | (2006.01) |
| ***A24B 13/00*** | (2006.01) |
| ***A24D 1/14*** | (2006.01) |
| ***A24F 5/04*** | (2006.01) |

(Continued)

(52) U.S. Cl.

CPC ..... *A24F 5/00* (2013.01); *A24B 13/00* (2013.01); *A24D 1/14* (2013.01); *A24F 1/30* (2013.01); *A24F 5/04* (2013.01); *A24F 5/10* (2013.01)

(58) Field of Classification Search

CPC ..... A24F 5/00; A24F 5/10; A24F 5/04; A24F 1/30; A24F 19/02; A24B 13/00; A24D 1/14

USPC ..... 131/328, 173, 222, 178, 320, 348

See application file for complete search history.

(56) References Cited

U.S. PATENT DOCUMENTS

| | | | | |
|---|---|---|---|---|
| 2007/0215164 | A1* | 9/2007 | Mehio | A24F 1/30 131/173 |
| 2008/0060663 | A1* | 3/2008 | Hamade | A24B 13/00 131/178 |
| 2010/0126518 | A1* | 5/2010 | Saleh | A24D 1/14 131/222 |

FOREIGN PATENT DOCUMENTS

EP 2 179 667 B1 4/2014

OTHER PUBLICATIONS

International Search Report for related International Application No. PCT/EP2012/066846, filed Aug. 30, 2012, dated Feb. 15, 2013, 10 pages.

(Continued)

*Primary Examiner* — Alex Efta

(74) *Attorney, Agent, or Firm* — Ellen M. Bierman; Lowe Graham Jones PLLC

(57) ABSTRACT

The invention relates to a water pipe head (2) comprising a capsule (12) including smokable material (10), a first sealing element (6) being detachably attached to a first surface of the capsule and a second sealing element (3) being detachably attached to a second surface of the capsule for sealing the capsule, a guiding element (8) having a first opening in which the capsule is held, an opposing second opening and an intermediate passage connecting the first opening and the second opening, and a longish element (7) being attached to the first sealing element and extending from the first sealing element (6) through the intermediate passage and through the second opening to the outside of the guiding element.

19 Claims, 15 Drawing Sheets

(51) Int. Cl.
*A24F 1/30* (2006.01)
*A24F 5/10* (2006.01)

(56) References Cited

OTHER PUBLICATIONS

Examination Report issued by the Patent Office of the Cooperation Council for The Arab States of The Gulf in related GCC Application No. GC 2013-25164 dated Oct. 28, 2015, 4 pages.
Notification of the First Office Action dated Feb. 3, 2016 (+ English translation), in Chinese Patent Application No. 201280072621.X, 13 pages.
Office Action dated Jan. 25, 2016 (+ English summary), in Japanese Patent Application No. 2015-528883, 5 pages.
Official Action dated Feb. 25, 2016 (+ English summary), in Russian Patent Application No. 2014136802/12 (059582), 5 pages.

* cited by examiner

WATER PIPE HEAD

FIELD OF THE INVENTION

The invention relates to a water pipe head and a manufacturing method for manufacturing the water pipe head. The invention relates further to a water pipe comprising the water pipe head and a capsule of the water pipe head.

BACKGROUND OF THE INVENTION

US 2007/0215164 A1 discloses a disposable hookah bowl comprising a tobacco compartment with a heat inlet for accepting a downward passage of heat into the tobacco compartment and a particulate outlet. The hookah bowl further comprises an ignitable product shelf, disposed within the tobacco compartment having a particulate passage, for retaining a smokable product, a heat inlet seal, obstructively engaging the heat inlet, for retaining moisture within the tobacco compartment, and a particulate outlet seal, obstructively engaging the particulate outlet, for retaining moisture within the tobacco compartment.

The space sealed within the heat inlet seal and the particulate outlet seal is relatively large such that it is relatively likely that at some locations delimiting parts of this space are not perfectly sealed. Moisture may therefore leave the space and, thus, the tobacco compartment, thereby reducing the quality of the smokable material.

SUMMARY OF THE INVENTION

It is an object of the present invention to present a water pipe head that provides smokable material having a better quality. It is a further object of the present invention to present a manufacturing method for manufacturing the water pipe head, a water pipe comprising the water pipe head and a capsule for the water pipe head.

In a first aspect of the present invention a water pipe head is presented, wherein the water pipe head comprises:

- a capsule including smokable material and having a first surface with openings, which is directed towards a guiding element for guiding smoke from the capsule to a water pipe, and an opposing second surface with openings, which is directed away from the guiding element, for generating smoke,
- a first sealing element being detachably attached to the first surface of the capsule for sealing the openings of the first surface and a second sealing element being detachably attached to the second surface of the capsule for sealing the openings of the second surface,
- the guiding element having a first opening in which the capsule is held, an opposing second opening and an intermediate passage connecting the first opening and the second opening, wherein the capsule is held in the first opening such that the generated smoke is guidable from the capsule through the first opening, the intermediate passage and the second opening into the water pipe,
- a longish element being attached to the first sealing element and extending from the first sealing element through the intermediate passage and through the second opening to the outside of the guiding element.

Since the longish element, which is attached to the first sealing elements, extends from the first sealing element through the intermediate passage and through the second opening to the outside of the guiding element, a user can strip away the first sealing element from the first surface by pulling an end of the longish element outside of the guiding element. It is therefore not necessary, for instance, to seal the second opening of the guiding element which would lead to a larger sealed space, because even if the sealing is performed directly adjacent to the location, at which the smokable material is located, the sealing can still easily be removed by a user by using the longish element. The sealed space can therefore be relatively small, in particular not much larger than the space occupied by the smokable material, such that the likelihood that the space may not be perfectly sealed somewhere can be reduced. The smokable material is therefore less influenced by the surrounding atmosphere, which leads to a water pipe head with smokable material having an improved quality.

The water pipe head is preferentially a disposable element, which can directly or indirectly be arranged on a water pipe, wherein in the latter case an adapter may be used between the water pipe head and the water pipe for arranging the water pipe head on the water pipe.

It is preferred that the capsule comprises a base element with the first surface and a cap element with the second surface arranged on the base element. At least one of the base element and the cap element is preferentially a metal element, in particular an aluminum element. Moreover, at least one of the base element and the cap element may be anodized, in particular as per a desired flavor and/or branding.

Preferentially, the density of openings of the second surface is smaller in an outer region of the second surface than in an inner region of the second surface. For instance, the openings of the first surface may form a ring. The ring formed by the openings may have a radius within a range of 40 to 60 percent of the radius of the first surface. The radius of the ring is preferentially larger than the radius of the second opening of the guiding element. This ensures that, even if liquid would leak through the openings in the first surface of the capsule, the liquid does not directly fall through the second opening, but meets the inner wall of the guiding element, particularly if the guiding element is conical with the first opening of the guiding element being larger than the second opening.

The first surface may comprise at least one indentation such that the first surface comprises at least one upper portion and at least one lower portion, wherein at least one of the openings of the first surface is located in an upper portion of the first surface. In particular, the first surface can comprise for each opening an indentation, wherein each indentation can define a respective upper portion of the first surface and wherein each opening can be located at the upper portion of the first surface defined by the respective indentation. For instance, the indentations in the first surface can be arranged in a ring, wherein at the upper portions of the respective indentations the openings of the first surface can be provided such that the first surface comprises indentations with openings, which are arranged in a ring. Also this ring of indentations with the openings has preferentially a radius being larger than the radius of the second opening of the guiding element, particularly if the guiding element is conically shaped, wherein the first opening of the guiding element is larger than the second opening of the guiding element. Since the openings are preferentially located at the upper portions of the first surface formed by the indentations, the likelihood that liquid leaves the capsule through the openings can strongly be reduced.

The sealing elements preferentially provide an airtight sealing. It is further preferred that at least one of first sealing element and the second sealing element is adhesively attached to the first surface and the second surface, respectively, in particular by using a non-transferable glue. At least one of the first sealing element and the second sealing element may be a sticker. The sticker can be, for instance, a polypropylene or a polyethylene sticker. However, the sticker can also be made of another material. For instance, the sticker can comprise a metallic polyester film.

The first sealing element and the longish element are preferentially integrated and form a single element, i.e. a single sealing element can be provided, wherein a portion of the single sealing element covers the openings and another portion of the single sealing element is longish for being guided through the guiding element, wherein an end of this longish portion can be grasped for removing the sealing element from the surface.

In a preferred embodiment, the guiding element is conically shaped, wherein the first opening is larger than the second opening. The guiding element can comprise paper material. In particular, the guiding element can be a paper cone, which may comprise a BOPP lamination. However, the guiding element can also comprise another finish, for example a RendezVous Natural White finish.

It is also preferred that the guiding element comprises at its second opening a holding element for holding the guiding element on the water pipe. The holding element can be adapted to directly hold the guiding element on the water pipe, or to indirectly hold the guiding element on the water pipe, wherein in the latter case an adapter is inserted into the holding element and arranged on the water pipe for holding the guiding element and, thus, the water pipe head on the water pipe.

The holding element can be an integral part of the guiding element, wherein, for instance, edges of the second opening of the guiding element can be folded for forming the holding element. For instance, the holding element can be formed by an inner curl. However, the holding element can also be a separate element being attached to the second opening. For instance, the holding element can comprise at least one of a rubber bush, a metal ring and a dual cone.

The rubber bush has preferentially a shore hardness within a range of 60 to 70, further preferred within a range of 60 to 65. Moreover, it may have a translucent white finish. It is preferentially a silicone rubber bush. The bush is preferentially adapted to be held in the second opening of the guiding element by friction, wherein it may be conically shaped for providing the frictional force.

The material of the ring element can be steel, in particular mild steel. It can have a chrome finish. However, the material of the ring element can also be a different material and/or have a different finish. For instance, it can be aluminum and/or being anodized, in particular as per a desired flavor and/or branding. It can be arranged at the second opening of the guiding element and it can be crimped around the edge of the second opening for attaching the metal ring to the guiding element. The metal ring preferentially comprises an inner annular protrusion being arranged within the guiding element for receiving an adapter to be arranged on the water pipe.

The dual cone is preferentially a metal dual cone, in particular, an aluminum dual cone. A first cone of the dual cone is preferentially adapted to receive the guiding element and a second cone of the dual cone is preferentially adapted to receive an adapter to be arranged on the water pipe. The first cone is preferentially adhesively attached to the guiding element. In particular, the first cone can be glued to the guiding element.

The guiding element can comprise a grasping element for being grasped by user for facilitating at least one of arranging the water pipe head on and removing the water pipe head from the water pipe. The grasping element is preferentially formed by at least one of an indentation, a groove and a ring enclosing the guiding element. For instance, if the guiding element is a cone, two indentations can be provided on opposing locations at the outside of the cone such that two fingers of an adult person can be arranged within the indentations for grasping the guiding element. It is also possible that the outer part of the guiding element comprises a rim, in particular, a rubber rim, as grasping element, wherein the rim may be glued or attached by other means to the guiding element.

The second surface of the capsule can comprise a three-dimensional structure. In particular, the three-dimensional structure can be formed by indentations in the capsule, which are adapted to provide a gap between a heating element like charcoal, which may be placed on the second surface of the capsule, and the second surface.

In a further aspect of the present invention a water pipe comprising the water pipe head is presented.

Moreover, in a further aspect a manufacturing method for manufacturing the water pipe head is presented, wherein the manufacturing method comprises:

providing a capsule including smokable material and having a first surface with openings to be directed towards a guiding element for guiding smoke from the capsule to a water pipe and an opposing second surface with openings to be directed away from the guiding element for generating smoke, wherein a first sealing element is detachably attached to the first surface of the capsule for sealing the openings of the first surface and a second sealing element is detachably attached to the second surface of the capsule for sealing the openings of the second surface, wherein a longish element is attached to and extends from the first sealing element, attaching the capsule with the first and second sealing elements to the guiding element, which comprises a first opening in which the capsule is to be held, an opposing second opening for being arranged on the water pipe and an intermediate passage connecting the first opening and the second opening, such that the capsule is held in the first opening of the guiding element for guiding the generated smoke from the capsule through the first opening, the intermediate passage and the second opening into the water pipe, wherein the longish element of the first sealing element extends from the first sealing element through the intermediate passage and through the second opening to the outside of the guiding element.

In a further aspect of the present invention a capsule for a water pipe head is presented, wherein the capsule includes smokable material and has a first surface with openings, which in use is directed towards a guiding element for guiding smoke from the capsule to a water pipe, and an opposing second surface with openings, which in use is directed away from the guiding element, for generating smoke, wherein a first sealing element is detachably attached to the first surface of the capsule for sealing the openings of the first surface and a second sealing element is detachably attached to the second surface of the capsule for sealing the openings of the second surface.

It shall be understood that the water pipe head of claim 1, the water pipe of claim 18 and the manufacturing method of claim 19 have similar and/or identical preferred embodiments, in particular, as defined in the dependent claims.

It shall be understood that a preferred embodiment of the invention can also be any combination of the dependent claims with the respective independent claim.

These and other aspects of the invention will be apparent from and elucidated with reference to the embodiments described hereinafter.

DETAILED DESCRIPTION OF EMBODIMENTS

Figure 1:
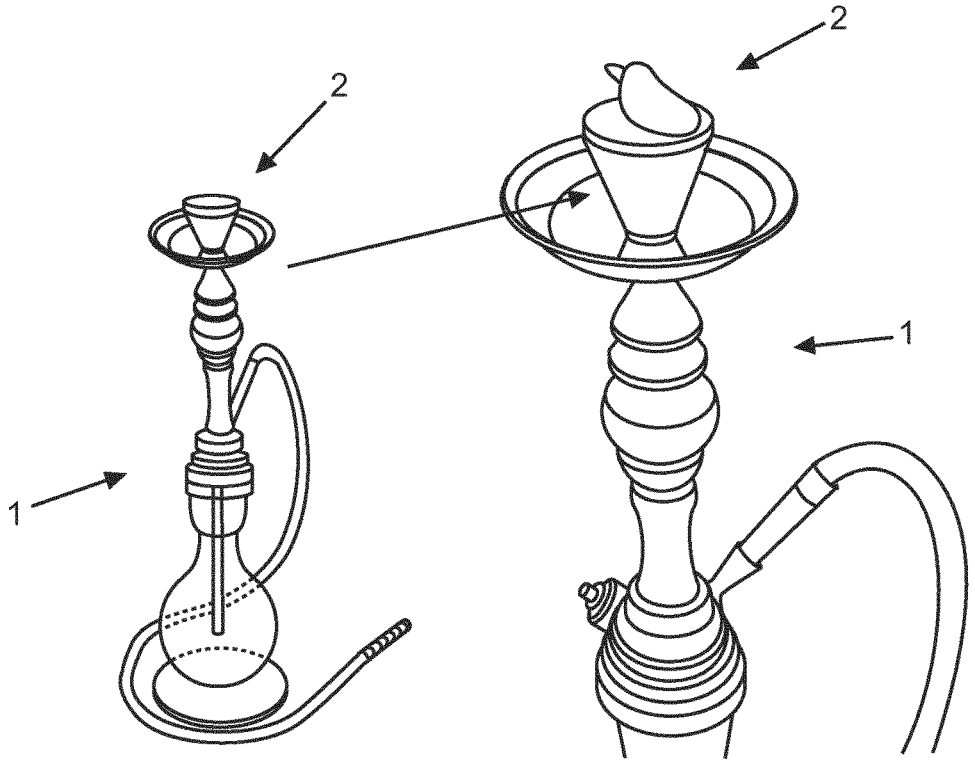
FIG. 1 shows schematically and exemplarily a water pipe with a water pipe head.
Figure 2:
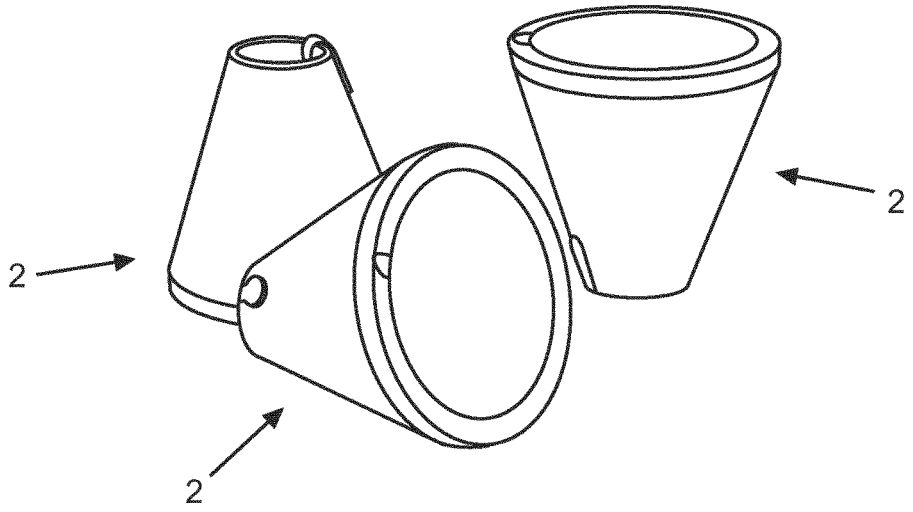
FIG. 2 shows schematically and exemplarily different perspective views of the water pipe head.
Figure 3:
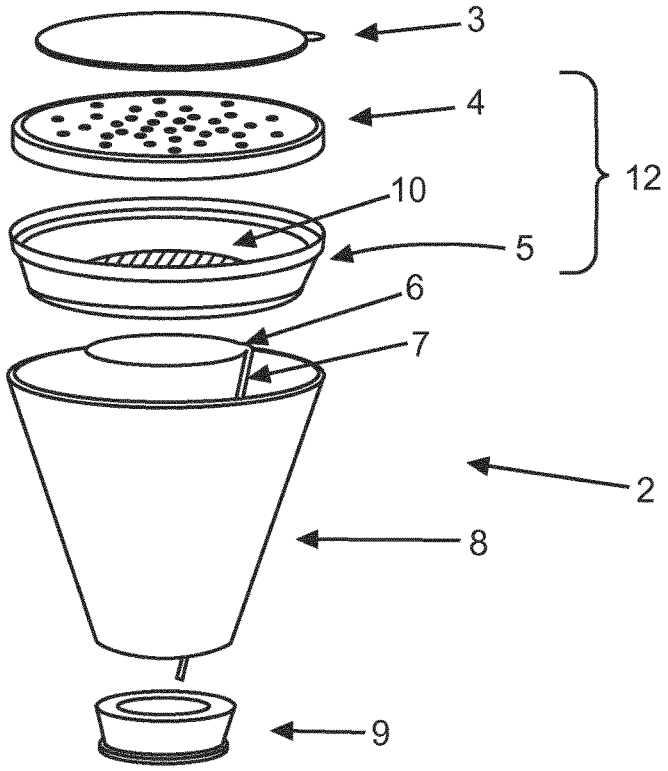
FIG. 3 shows schematically and exemplarily an exploded view of the water pipe head.
Figure 4:
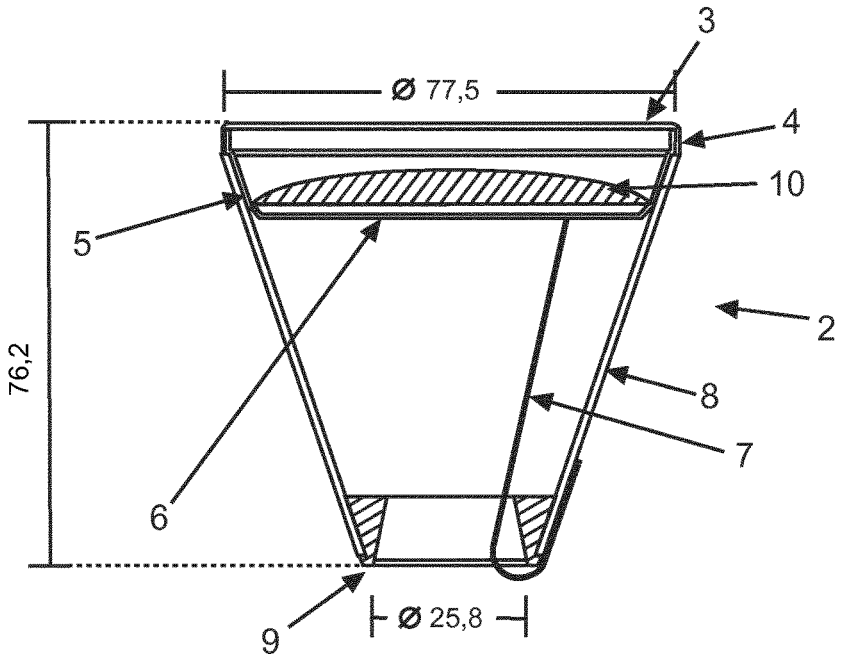
FIG. 4 shows schematically and exemplarily a sectional view of the water pipe head.

FIG. 1 shows on the left side schematically and exemplarily an entire water pipe 1 with a water pipe head 2 and on the right side an upper part of the water pipe 1 with the water pipe head 2. FIG. 2 shows schematically and exemplarily the water pipe head 2 from different perspectives, FIG. 3 shows schematically and exemplarily an exploded view and FIG. 4 shows schematically and exemplarily a sectional view of the water pipe head 2 shown in FIGS. 1 to 3.

Figure 8:
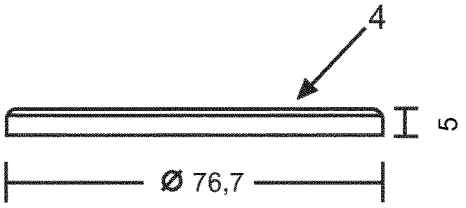
FIG. 8 shows schematically and exemplarily a side view of the cap element.
Figure 9:
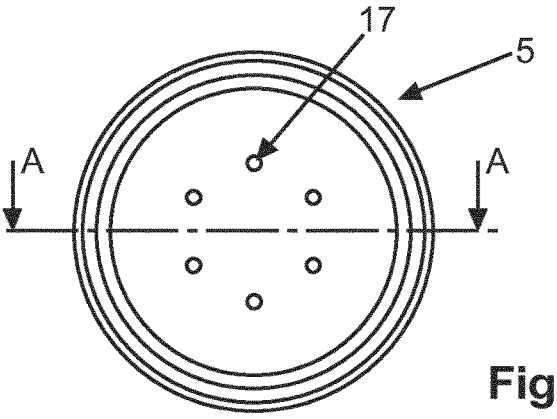
FIG. 9 shows schematically and exemplarily a top view on a base element of the water pipe head.
Figure 10:
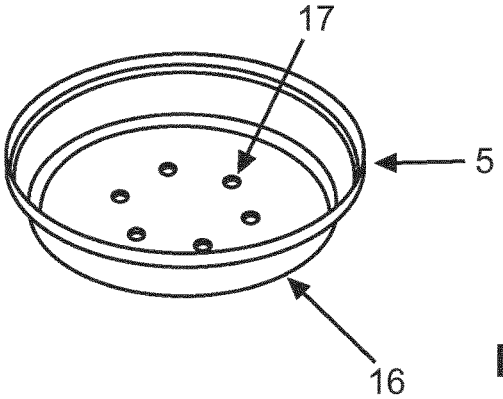
FIG. 10 shows schematically and exemplarily a perspective view of the base element.
Figure 11:
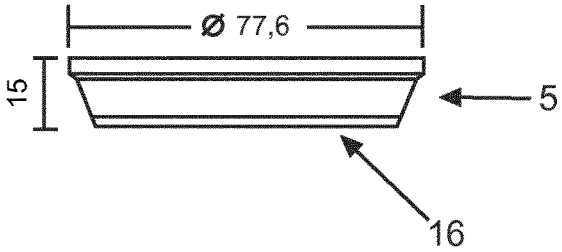
FIG. 11 shows schematically and exemplarily a side view of the base element.

The water pipe head 2 comprises a capsule 12 including smokable material 10. The capsule 12 comprises a base element 5 which is shown in more detail in FIGS. 9 to 11, and a cap element 4 which is shown in more detail in FIGS. 6 to 8. The base element 5 comprises a first surface 16 with openings 17, wherein the first surface 16 is directed towards a guiding element 8 for guiding smoke from the capsule 12 to the water pipe 1. The openings 17 of the first surface 16 form a ring, wherein the ring formed by the openings 17 has a radius within a range of 40 to 60 percent, preferentially of 50 percent, of the radius of the first surface 16. As can be seen in FIGS. 9 to 11, the base element 5 is substantially basin-like, wherein the bottom of the basin-like base element 5 comprises the ring of openings 17. In this embodiment, the base element 5 is made of aluminum having a thickness of 0.5 mm (grade 3003-H14), wherein the thickness can be different in other embodiments. For instance, it can be 0.3 mm. The aluminum is anodized, in particular as per a desired flavor and/or branding. The openings 17 have each a diameter of 3 mm and the number of openings 17 is six in this embodiment. However, the openings 17 can also have a different diameter and/or there can be a different number of openings 17. For example, the openings 17 can each have diameter of 2 mm. This diameter can ensure that a desired suction is present. Moreover, by using the described configuration of openings 17 a good airflow can be provided, in particular the likelihood of backflows can be reduced.

The cap element 4 comprises a second surface 13, which opposes the first surface 16, with openings 14, wherein the second surface 13 is directed away from the guiding element 8. The capsule 12 comprises therefore the first surface 16 with openings 17, which is directed towards the guiding element 8 for guiding smoke from the capsule 12 to the water pipe 1, and an opposing second surface 13 with openings 14, which is directed away from the guiding element 8.

Figure 6:
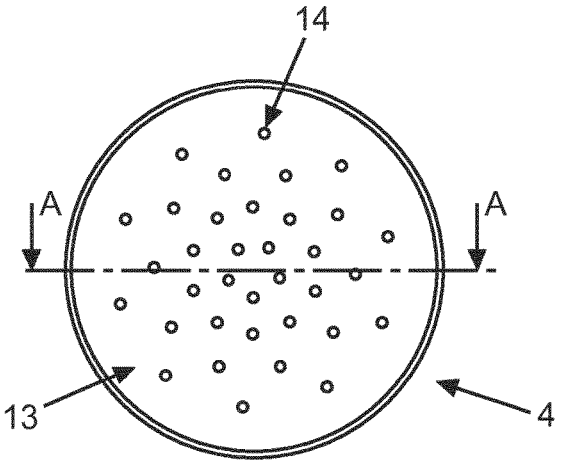
FIG. 6 shows schematically and exemplarily a top view on a cap element of the water pipe head.
Figure 7:
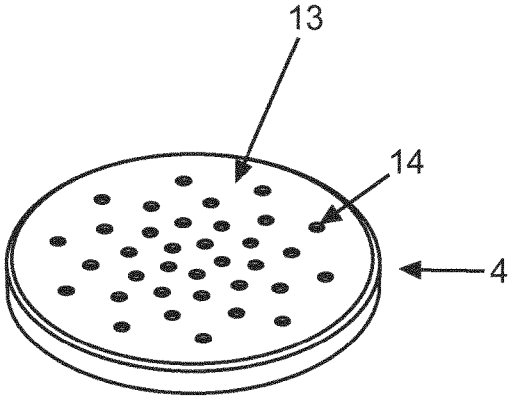
FIG. 7 shows schematically and exemplarily a perspective view on the cap element.

In this embodiment, the cap element 4 is also made of aluminum having a thickness of 0.5 mm (grade 3003-H14). However, the cap element 4 can also be made of aluminum having a different thickness and/or a different metal. For instance, the thickness can be 0.3 mm. The cap element 4 has a glossy brushed aluminum finish. As can be seen in FIGS. 6 and 7, the density of the openings 14 of the second surface 13 is smaller in an outer region of the second surface 13 than in an inner region of the second surface 13. In this embodiment, the cap element 4 has 36 openings each having a diameter of 1.5 mm. Nevertheless, the cap element 4 can also have a different number of openings with a different diameter. For example, the cap element 4 can have 69 openings each having a diameter of 2 mm. For starting the smoking process a heat source like a piece of coal can be arranged on the inner region of the second surface 13, whereupon the heat source can be moved towards the circumference of the second surface 13 as desired for regulating the heating and the airflow.

Figure 13:
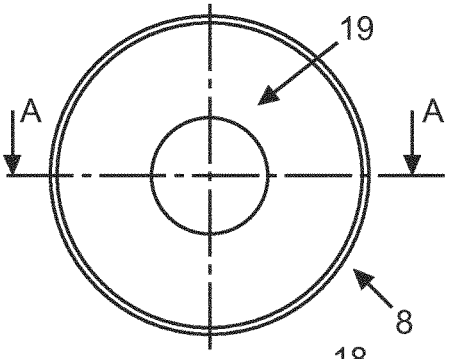
FIG. 13 shows schematically and exemplarily a top view on a guiding element of the water pipe head.
Figure 14:
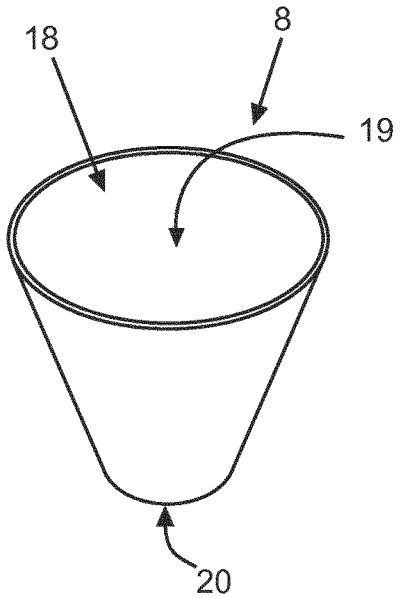
FIG. 14 shows schematically and exemplarily a perspective view of the guiding element.
Figure 15:
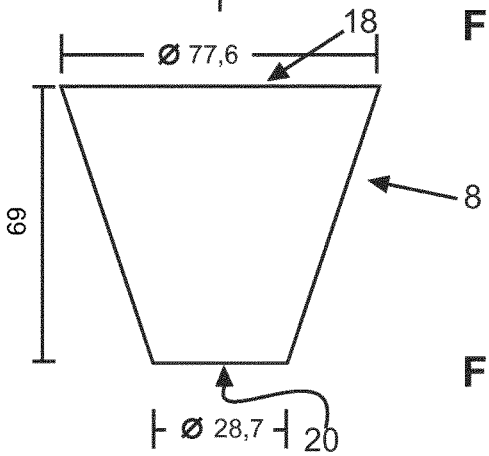
FIG. 15 shows schematically and exemplarily a side view of the guiding element.

The water pipe head 2 further comprises a first sealing element 6 being detachably attached to the first surface 16 of the capsule 12 for sealing the openings 17 of the first surface 16 and a second sealing element 3 being detachably attached to the second surface 13 of the capsule 12 for sealing the openings 14 of the second surface 13. The first sealing element 6 is schematically and exemplarily shown in more detail in FIG. 12 and the second sealing element 3 is schematically and exemplarily shown in more detail in FIG. 5. Moreover, the water pipe head 2 comprises the guiding element 8, which is schematically and exemplarily shown in more detail in FIGS. 13 to 15, and a longish element 7, which is schematically and exemplarily shown in more detail in FIG. 12.

The guiding element 8 has a first opening 18, in which the capsule 12 is held, an opposing second opening 20 for being arranged directly or indirectly on the water pipe 1 and an intermediate passage 19 connecting the first opening 18 and the second opening 20, wherein the capsule 12 is held in the first opening 18 such that the generated smoke is guided from the capsule 12 through the first opening 18, the intermediate passage 19 and the second opening 20 into the water pipe 1. In this embodiment, the guiding element is a paper cone made of Samwha Paper (240 gsm). However, the paper cone can also be made of a different paper and/or having a different specific weight, for example 450 gsm. The paper cone may have a single side BOPP lamination. However, the paper cone can also comprise another finish, for example a RendezVous Natural White finish. The paper cone can have three layers and can have a thickness of 1.5 mm.

The ring of openings 17 and the guiding element 8 are preferentially configured such that the radius of the ring of openings 17 is larger than the radius of the second opening 20 of the guiding element 8. This can ensure that, if a liquid leaks through the openings 17, the liquid does not directly fall through the second opening 20 of the guiding element 8, but meets the inner wall of the guiding element 8. The capsule 12 and the first opening 18 of the guiding element 8 can be adapted such that the capsule 12 is held in the first opening 18 of the guiding element 8, if the capsule 12 is introduced and slightly pressed into the guiding element 8, without necessarily needing an adhesive.

Figure 12:
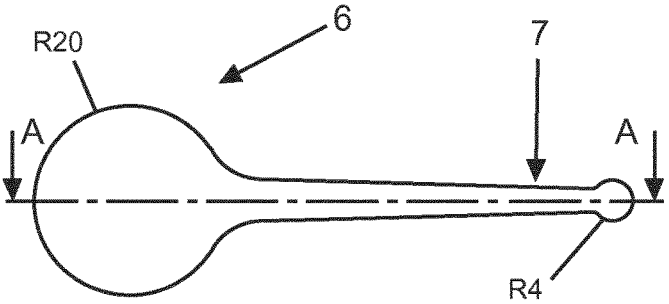
FIG. 12 shows schematically and exemplarily a top view on a first sealing element with a longish element of the water pipe head.

Referring to FIG. 12, the first sealing element 6 and the longish element 7 are integrated and form a single element. The first sealing element 6 is substantially circular and the longish element 7 has a width that decreases with increasing distance to the first sealing element 6 up to a substantially circular end which is opposite to the first sealing element 6. The substantially circular end of the longish element 7 can be grabbed by a person for stripping the first sealing element 6 away from the openings 17 of the base element 5. The integrated element including the first sealing element 6 and the longish element 7 is preferentially a polypropylene or polyethylene sticker (150 gsm). However, the sticker can also be made of another material. For instance, the sticker can comprise a metallic polyester film with a thickness of, for instance, 0.2 mm. The surface, which is attached to the base element 5, comprises preferentially a nontransferable glue. In this embodiment the entire element including the first sealing element 6 and the longish element 7 has a length of 179 mm. However, in other embodiments the dimensions can of course be different. For example, the length can be 124 mm.

Figure 5:
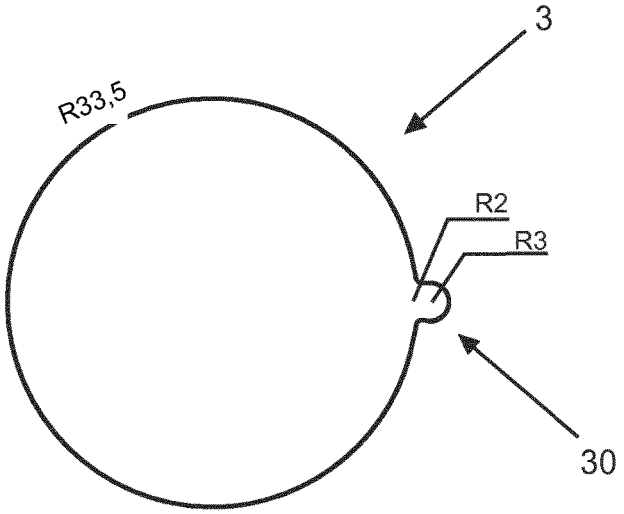
FIG. 5 shows schematically and exemplarily a top view on a second sealing element of the water pipe head.

Referring to FIG. 5, the second sealing element 3 is preferentially circularly shaped and comprises a relatively small extension 30, which can be grabbed by a user, for stripping the second sealing element 3 away from the second surface 13 of the cap element 4. Also the second sealing element 3 is preferentially a polypropylene or polyethylene sticker (150 gsm). However, the sticker can also be made of another material. For instance, the sticker can comprise a metallic polyester film with a thickness of, for instance, 0.2 mm. The surface, which is detachably attached to the second surface 13 of the cap element 4, comprises a non-transferable glue. The opposing side of the second sealing element 3, i.e. the top side in use, can comprise text or graphics. In this embodiment the diameter of the second sealing element 3 is 67 mm. However, in other embodiments the dimensions can of course be different. For example, the diameter can be 82 mm.

The parts of the first and second sealing elements, which should be grabbed by a user, are preferentially not provided with the non-transferable glue.

The guiding element 8 comprises at its second opening 20 a holding element 9 for holding the guiding element on the water pipe 1. The holding element 9 can be adapted to directly hold the guiding element 8 on the water pipe 1, or to indirectly hold the guiding element 8 on the water pipe 1, wherein in the latter case an adapter is inserted into the holding element 9 and arranged on the water pipe 1 for holding the guiding element 8 and, thus, the water pipe head 2 on the water pipe 1. The holding element 9 can be a rubber bush which is schematically and exemplarily shown in more detail in FIGS. 16 to 18.

The rubber bush 9 comprises an inner conical opening having a decreasing diameter with increasing distance to the water pipe 1 for receiving the water pipe 1 or an adapter. The circumferential surface of the rubber bush 9 is conically shaped with an increasing diameter with increasing distance to the water pipe 1 for being received within the second opening 20 of the guiding element 8. The second opening 20 of the guiding element 8 and the circumferential outer conical surface of the rubber bush 9 can be adapted such that the rubber bush 9 is held within the guiding element 8, if the rubber bush 9 is introduced and slightly pressed into the guiding element 8. Also the adapter may be held within the opening of the rubber bush 9 by introducing and slightly pressing the adapter into the opening of the rubber bush 9. The rubber bush 9 is preferentially a silicone rubber bush with a translucent white finish. The shore hardness may be between 60 and 70. Preferentially, the shore hardness is 70. However, the shore hardness can also be different. For instance, it may be in the range between 60 and 65.

Figure 18:
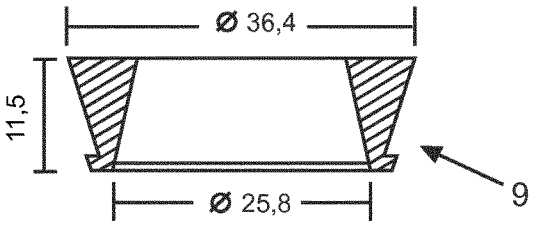
FIG. 18 shows schematically and exemplarily a sectional side view of the rubber bush.
Figure 19:
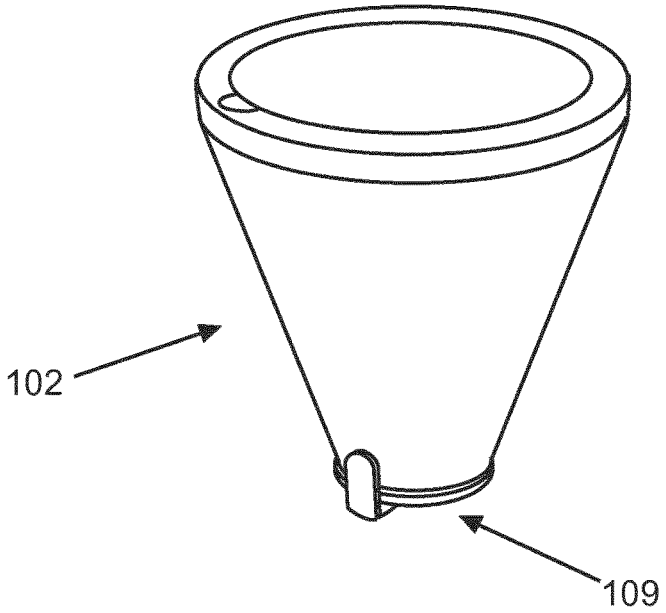
FIG. 19 shows schematically and exemplarily a perspective view of a further embodiment of the water pipe head.
Figure 20:
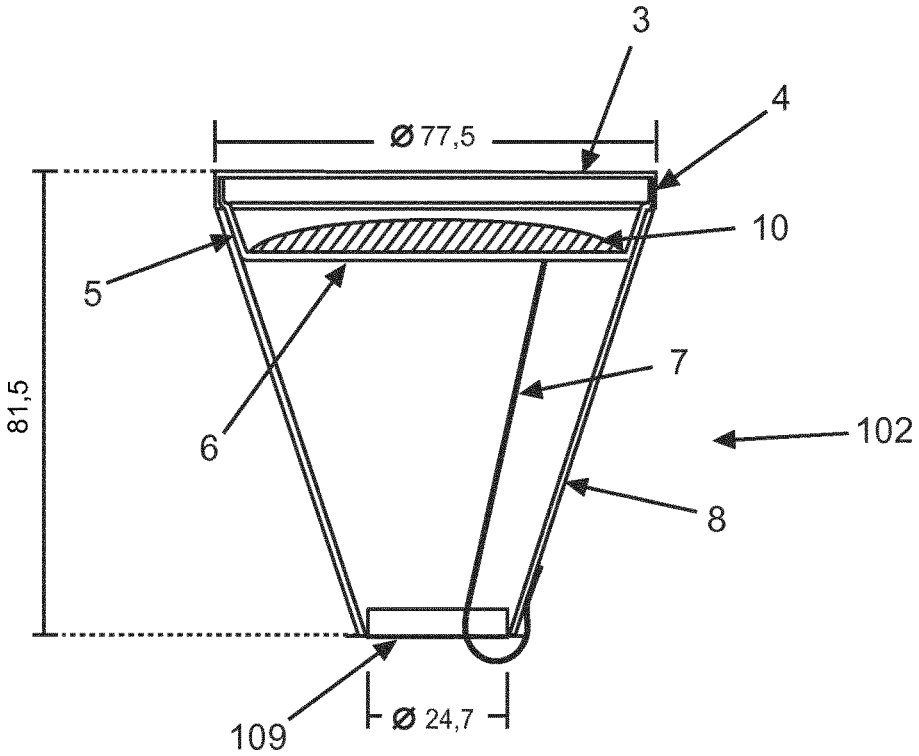
FIG. 20 shows schematically and exemplarily a sectional view of the water pipe head shown in FIG. 19.

FIG. 19 shows schematically and exemplarily a further embodiment of the water pipe head, which can be used together with the water pipe 1. The water pipe head 102 shown in FIG. 19 is similar to the water pipe head 2 described above with reference to FIGS. 1 to 18, except for the holding element 109 being, in this embodiment, a metal ring. The metal ring 109 is crimped at the bottom edge of the second opening of the guiding element. FIG. 19 shows schematically and exemplarily a perspective view of the water pipe head 102, whereas FIG. 20 shows schematically and exemplarily a sectional view of the water pipe head 102. As can be seen in FIG. 20, also the water pipe head 102 comprises the first and second sealing elements 3, 6, the longish element 7, the guiding element 8 and the capsule with the cap element 4, the base element 5 and the smokable material 10.

Figure 21:
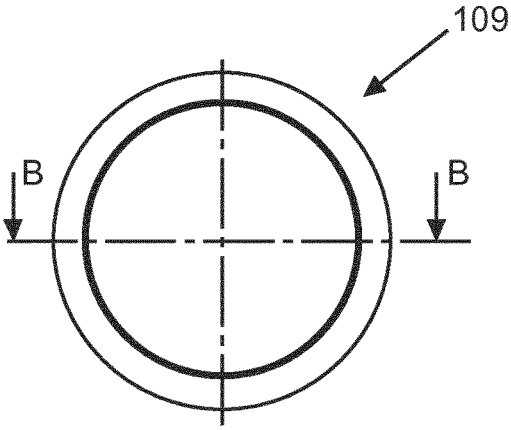
FIG. 21 shows schematically and exemplarily a top view on a ring element of the water pipe head shown in FIG. 19.
Figure 22:
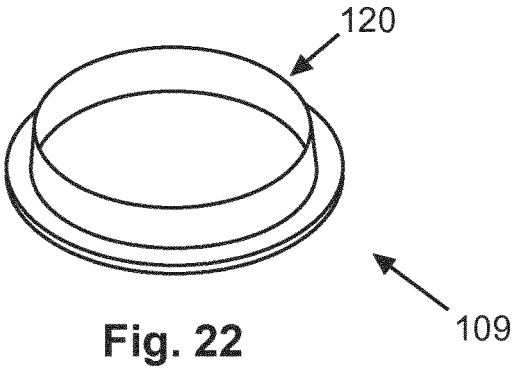
FIG. 22 shows schematically and exemplarily a perspective view of the ring element.
Figure 23:
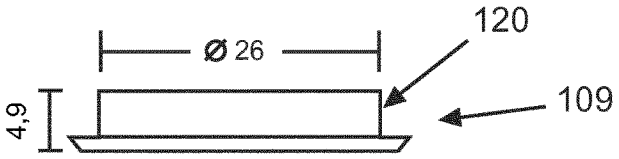
FIG. 23 shows schematically and exemplarily a side view of the ring element.

The metal ring 109 is schematically and exemplarily shown in more detail in FIGS. 21 to 23. The metal ring 109 comprises an inner annular protrusion 120 being arranged within the guiding element 8 and being adapted to receive an upper part of the water pipe 1 or an adapter to be arranged on the water pipe 1. The metal ring is preferentially made of aluminum. The aluminum may have a thickness of 0.5 mm. The metal ring 109 may have an anodized finish, in particular as per a desired flavor and/or branding. Nevertheless, the metal ring can also be made of a different material and may comprise a different finish. For example, the metal ring may be made of mild steel having a thickness of, for instance, 0.2 mm. The metal ring 109 may have a chrome finish.

Figure 24:
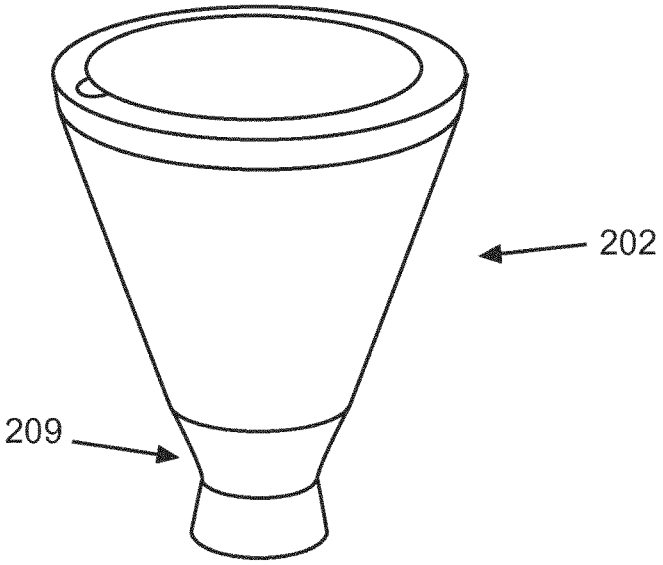
FIG. 24 shows schematically and exemplarily a perspective view of a further embodiment of the water pipe head.

FIG. 24 shows schematically and exemplarily a further embodiment of a water pipe head, which can be used together with the water pipe 1. The water pipe head 202 schematically and exemplarily shown in FIG. 24 is similar to the water pipe heads 2 and 102 described above, except for the holding element 209 being, in this embodiment, a dual cone. The dual cone 209 gives the guiding element a good structural strength and the water pipe head 202 may retain its position on the water pipe 1 purely because of its form.

Figure 25:
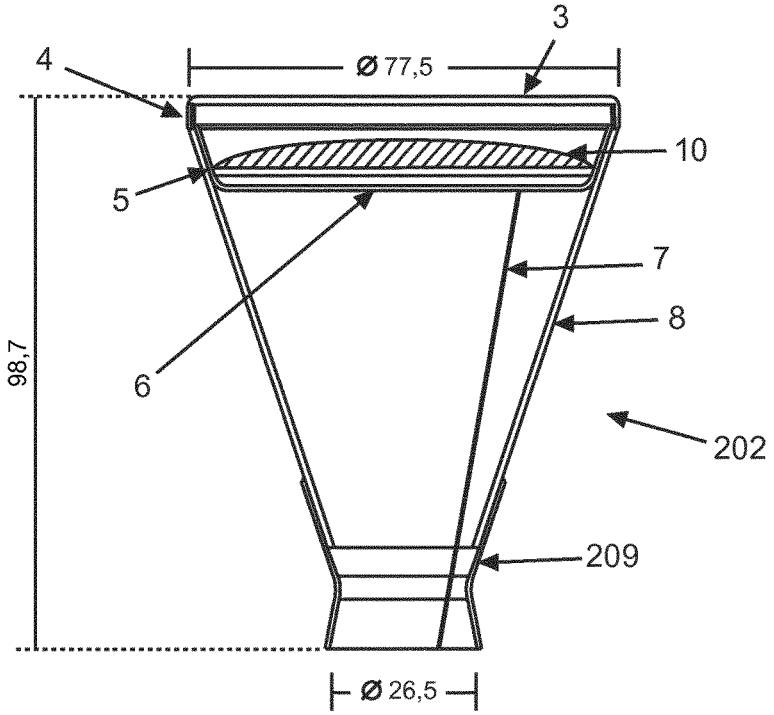
FIG. 25 shows schematically and exemplarily a sectional view of the water pipe head shown in FIG. 24.
Figure 26:
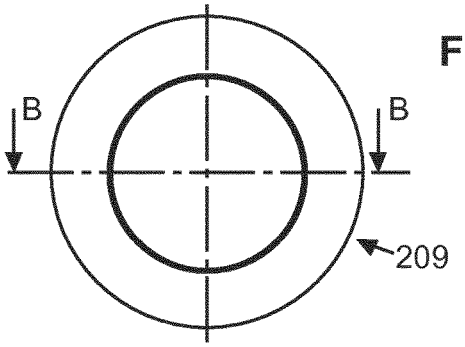
FIG. 26 shows schematically and exemplarily a top view on a dual cone of the water pipe head shown in FIG. 24.
Figure 27:
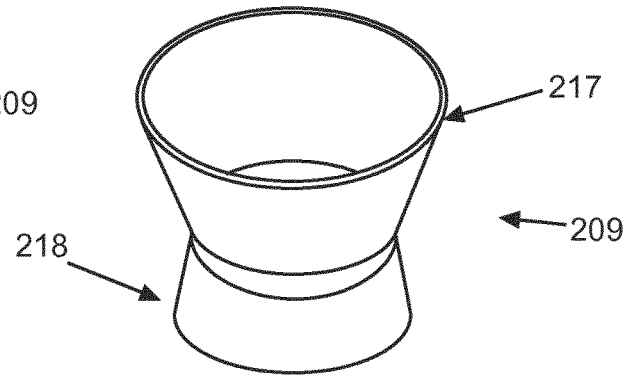
FIG. 27 shows schematically and exemplarily a perspective view of the dual cone.
Figure 28:
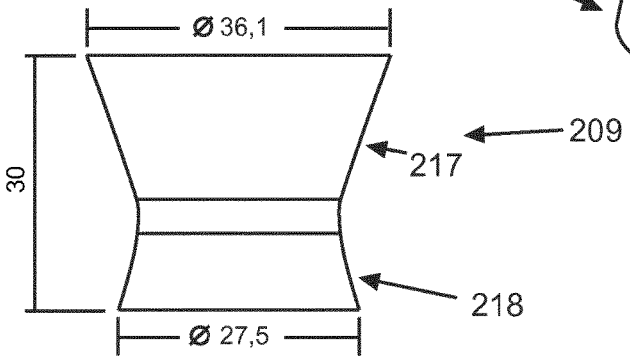
FIG. 28 shows schematically and exemplarily a sectional side view of the dual cone.

As can be seen in FIG. 25, which exemplarily and schematically shows a sectional view of the water pipe head 202, also the water pipe head 202 comprises the first and second sealing elements 3, 6, the longish element 7, the capsule with the cap element 4, the base element 5 and the smokable material 10 and the guiding element 8. The dual cone 209 is schematically and exemplarily shown in more detail in FIGS. 26 to 28.

The dual cone 209 comprises a first cone 217 being adapted to receive the guiding element 8 and a second cone 218 being adapted to receive the water pipe 1 or an adapter to be arranged on the water pipe 1. The first cone 217 is preferentially adhesively attached to the guiding element 8, in particular the first cone 217 is glued to the guiding element 8. The dual cone 209 is preferentially a metal cone, for instance, an aluminum cone, having a thickness of, for example, 1 mm (grade 3003-H14). However, it may also have a different thickness and/or may be made of a different metal. For example, the thickness can be 0.5 mm. It can have an anodized finish.

Figure 29:
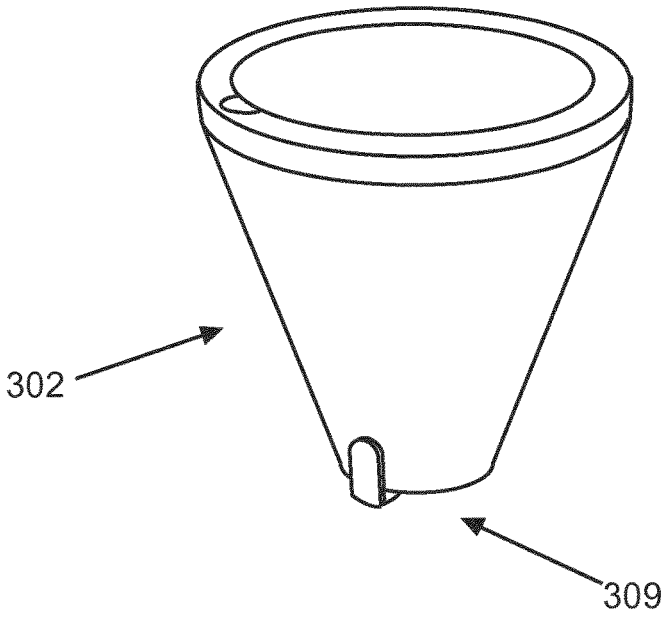
FIG. 29 shows schematically and exemplarily a perspective view of a further embodiment of the water pipe head.

FIG. 29 shows schematically and exemplarily a further embodiment of a water pipe head, which can be used together with the water pipe 1. The water pipe head 302 schematically and exemplarily shown in FIG. 29 is similar to the water pipe heads 2, 102 and 202 described above, again except for the holding element 309 being, in this embodiment, a bottom inner curl of the guiding element 8. The holding element 309 can be formed by folding edges of the second opening 20 of the guiding element 8, for instance, to the inside of the guiding element. The bottom inner curl 309 gives the guiding element 8 very good structural strength.

Figure 30:
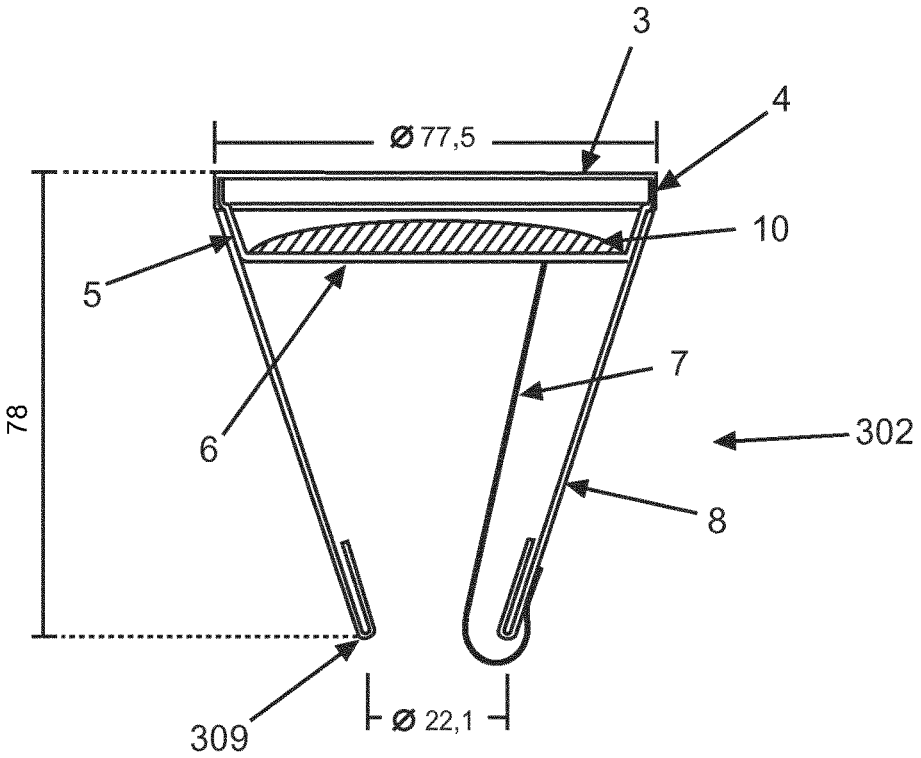
FIG. 30 shows schematically and exemplarily a sectional view of the water pipe head shown in FIG. 29.

As can be seen in FIG. 30, which exemplarily and schematically shows a sectional view of the water pipe head 302, also the water pipe head 302 comprises the first and second sealing elements 3, 6, the longish element 7, the capsule with the cap element 4, the base element 5, the smokable material 10 and the guiding element 8. The holding element 309 is formed by an inner curl of the second opening 20 on the bottom side of the guiding element 8. The holding element 309 thus becomes an integral part of the guiding element 8. The guiding element 8 and hence also the holding element 309 may in this embodiment be made of, for example, kraft paper with a cone thickness of for example 1.5 mm.

Figure 16:
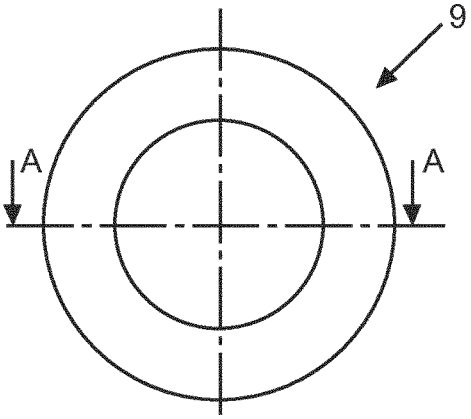
FIG. 16 shows schematically and exemplarily a top view on a rubber bush of the water pipe head.
Figure 17:
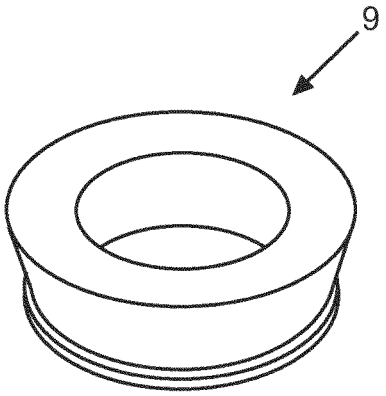
FIG. 17 shows schematically and exemplarily a perspective view of the rubber bush.

In the following alternative embodiments of the rubber bush 9, which was described above in detail with reference to, for example, FIGS. 16 to 18, are presented. The rubber bushes 409 and 509 are schematically and exemplarily shown in FIGS. 31 to 36.

Figure 32:
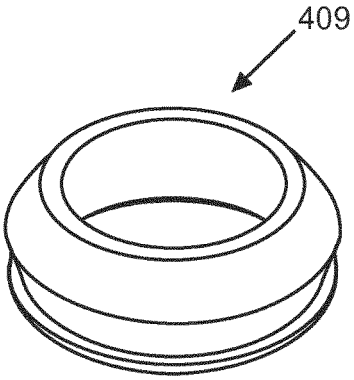
FIG. 32 shows schematically and exemplarily a perspective view of the first alternative embodiment of the rubber bush.
Figure 31:
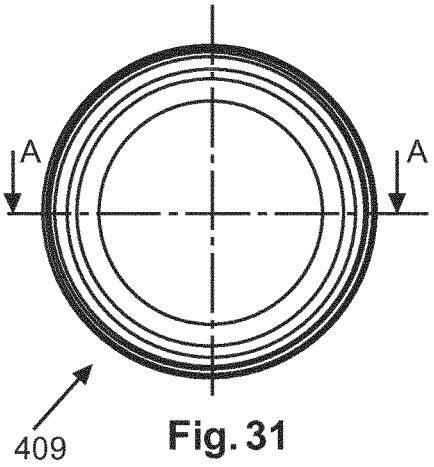
FIG. 31 shows schematically and exemplarily a top view on a first alternative embodiment of the rubber bush of the water pipe head.
Figure 33:
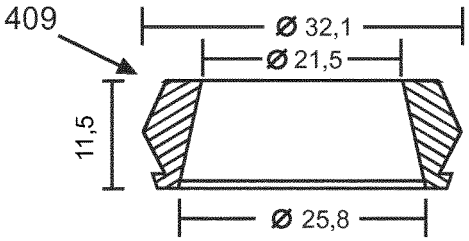
FIG. 33 shows schematically and exemplarily a sectional side view of the first alternative embodiment of the rubber bush.

The first alternative embodiment of the rubber bush 409 is schematically and exemplarily shown in FIGS. 31 to 33. It is similar to the rubber bush 9 as shown, for example, in FIGS. 16 to 18 and discussed earlier, except for the chamfer at the top outer edge in rubber bush 409. FIG. 31 shows schematically and exemplarily a top view on rubber bush 409, FIG. 32 shows schematically and exemplarily a perspective view of the rubber bush 409 and FIG. 33 shows schematically and exemplarily a sectional side view of rubber bush 409. The rubber bush 409 is preferentially a silicone rubber bush with a translucent white finish having a shore hardness of 70.

Figure 34:
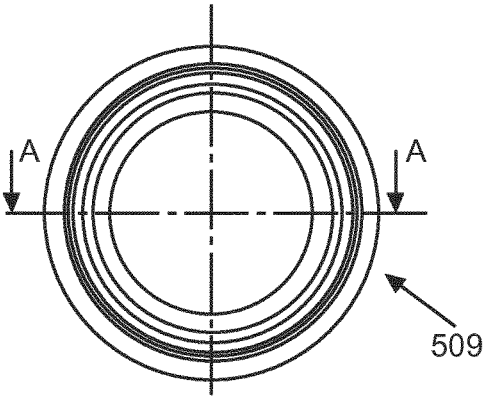
FIG. 34 shows schematically and exemplarily a top view on a second alternative embodiment of the rubber bush of the water pipe head.
Figure 35:
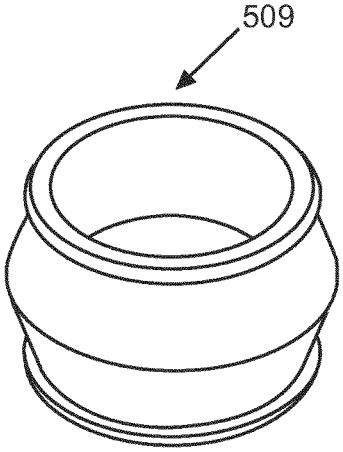
FIG. 35 shows schematically and exemplarily a perspective view of the second alternative embodiment of the rubber bush.
Figure 36:
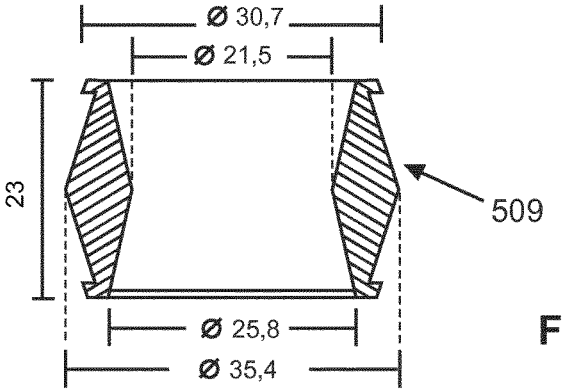
FIG. 36 shows schematically and exemplarily a sectional side view of the second alternative embodiment of the rubber bush.

FIGS. 34 to 36 schematically and exemplarily show a second alternative rubber bush 509 in analogous views as in FIGS. 31 to 33. The second alternative rubber bush 509 basically comprises two rubber bush parts, which each are similar to the rubber bush 9 described above with reference to FIGS. 16 to 18, wherein one of the two parts is inverted, and both parts are joined on the side of each of the rubber bush parts having the largest diameter. Instead of being two rubber bush parts similar to the rubber bush 9 joined together, the second alternative rubber bush 509 can also be a single component having the shape as shown schematically and exemplarily in FIGS. 34 to 36. The rubber bush 509 is also preferentially a silicone rubber bush with a translucent white finish having a shore hardness of 70.

Figure 37:
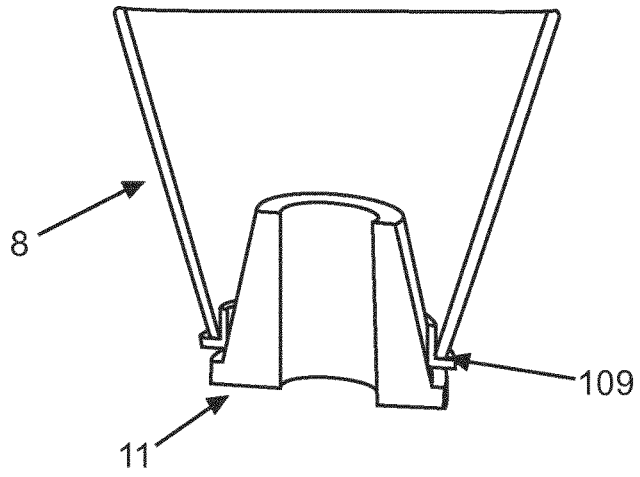
FIG. 37 shows schematically and exemplarily the lower part of the water pipe head shown in FIG. 19 together with a first adapter.
Figure 38:
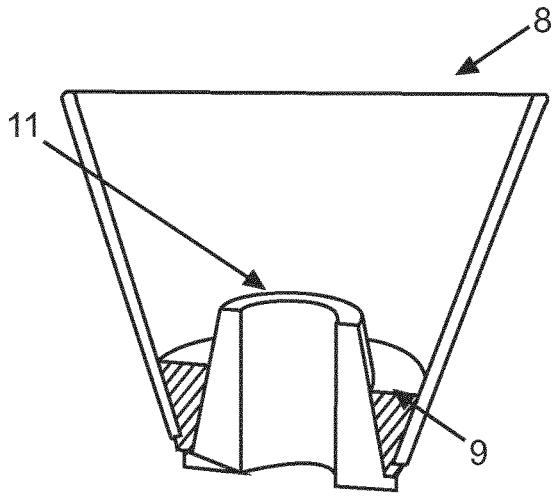
FIG. 38 shows schematically and exemplarily the lower part of the water pipe head shown in FIG. 2 together with the first adapter.
Figure 39:
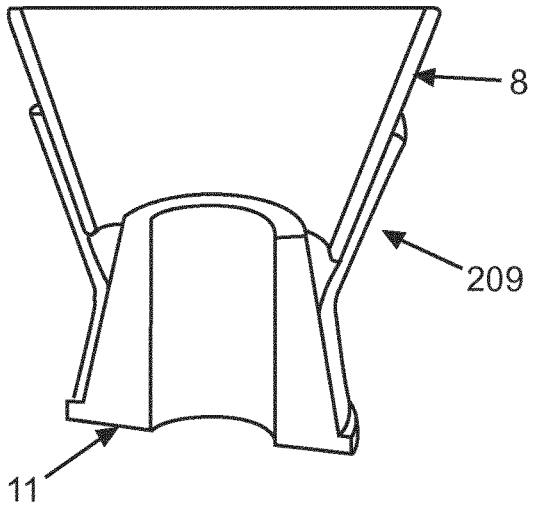
FIG. 39 shows schematically and exemplarily the lower part of the water pipe head shown in FIG. 24 together with the first adapter.
Figure 40:
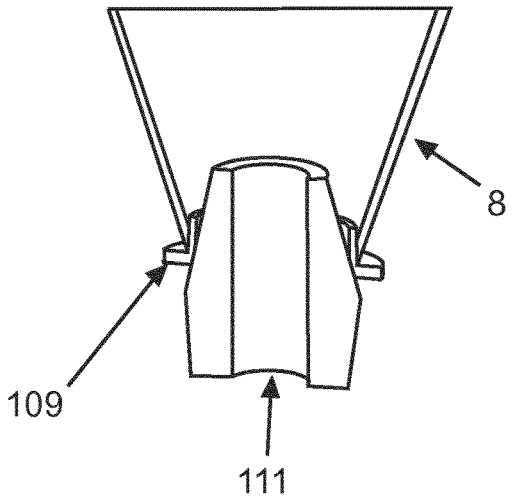
FIG. 40 shows schematically and exemplarily the lower part of the water pipe head shown in FIG. 19 together with a second adapter.
Figure 41:
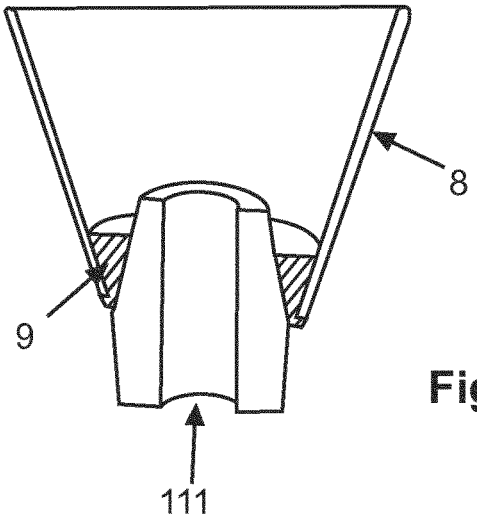
FIG. 41 shows schematically and exemplarily the lower part of the water pipe head shown in FIG. 2 together with the second adapter.
Figure 42:
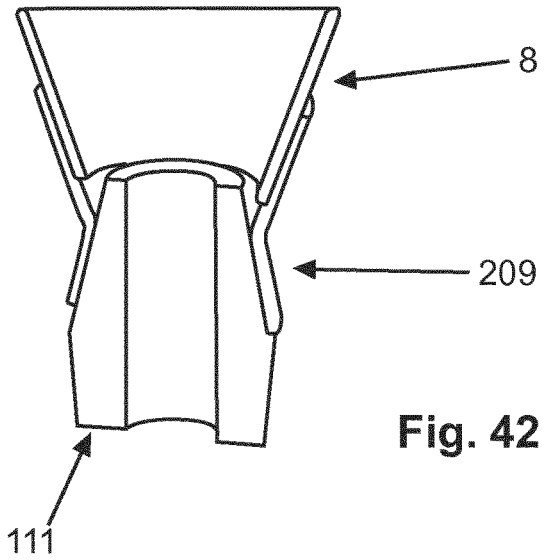
FIG. 42 shows schematically and exemplarily the lower part of the water pipe head shown in FIG. 24 together with the second adapter.

FIGS. 37 to 39 schematically and exemplarily show lower parts of the respective embodiment of the water pipe head with an adapter 11. In FIG. 37 the water pipe head 102 with the metal ring 109 is shown together with the adapter 11. In FIG. 38, the water pipe head 2 with the rubber bush 9 is shown together with the adapter 11, and, in FIG. 39, the water pipe head 202 with the dual cone 209 is shown together with the adapter 11. FIGS. 40 to 42 show these embodiments of the water pipe head together with another adapter 111, wherein FIG. 40 shows the water pipe head 102 with the metal ring 109, FIG. 41 shows the water pipe head 2 with the rubber bush 9 and FIG. 42 shows the water pipe head 202 with the dual cone 209. The adapter 11 shown in FIGS. 37 to 39 can be regarded as being a modern adapter and the adapter 111 shown in FIGS. 40 to 42 can be regarded as being a Syrian adapter. The respective adapter is preferentially a rubber or plastic adapter.

Figure 43:
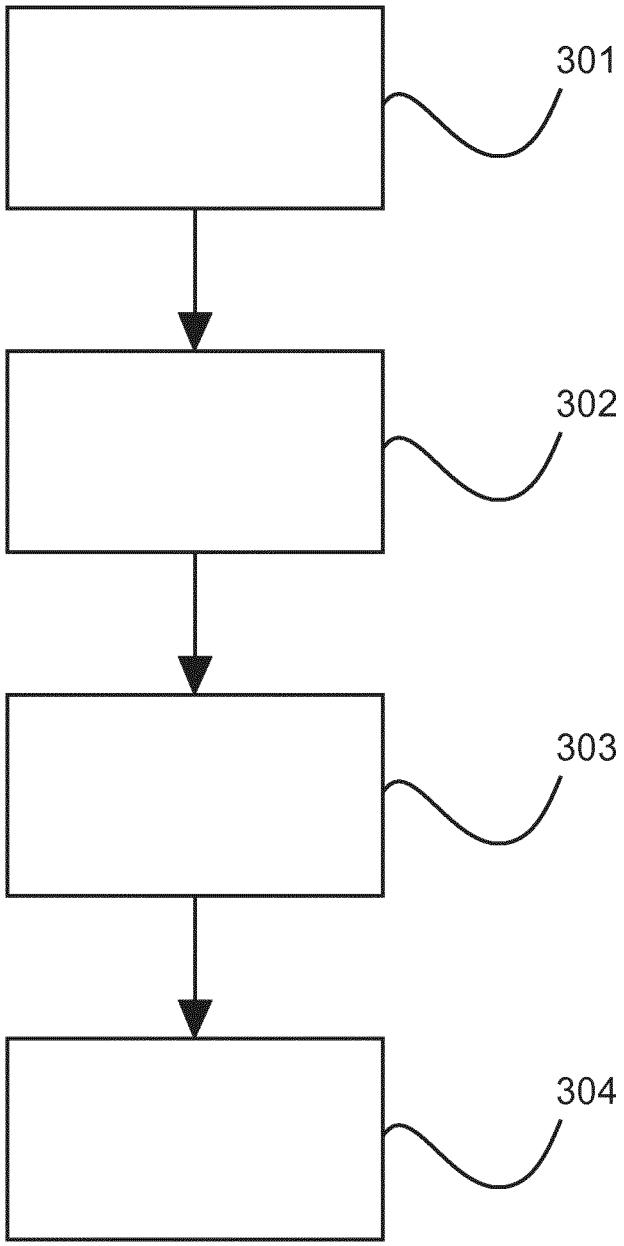
FIG. 43 shows a flowchart exemplarily illustrating an embodiment of a manufacturing method for manufacturing a water pipe head.

In the following an embodiment of a manufacturing method for manufacturing a water pipe head will exemplarily be described with reference to a flowchart shown in FIG. 43.

In step 301 a capsule is provided including smokable material and having a first surface with openings to be directed towards a guiding element for guiding smoke from the capsule to a water pipe and an opposing second surface with openings to be directed away from the guiding element for generating smoke. In particular, a base element, a cap element and the smokable material can be provided, wherein the smokable material can be located within the base element, whereupon the cap element can be arranged on the base element for forming the capsule. The cap element and the base element can be adapted such that, after the cap element has been pressed onto the base element, the cap element is held on the base element, in particular, by frictional forces, preferentially without requiring further attaching means like an adhesive.

In step 302 a first sealing element is detachably attached to the first surface of the capsule for sealing the openings of the first surface and the second sealing element is detachably attached to the second surface of the capsule for sealing the openings of the second surface, wherein a longish element is attached to and extends from the first sealing element.

In step 303 the capsule with the first and second sealing elements is attached to the guiding element, which comprises a first opening in which the capsule is to be held, an opposing second opening and an intermediate passage connecting the first opening and the second opening, such that the capsule is held in the first opening of the guiding element, wherein the longish element of the first sealing element extends from the first sealing element through the intermediate passage and through the second opening to the outside of the guiding element.

In step 304 the guiding element may be provided with a holding element like a rubber bush, a metal ring, a dual cone or an inner curl.

In other embodiments the order of the steps of the manufacturing method can also be different. For example, step 304 may also be performed before step 303. Moreover, the manufacturing method can comprise other steps. For instance, firstly a thin, planar, perforated metal plate can be used, wherein the perforation may provide the openings 14 shown in, for instance, FIG. 6. The second sealing element can be detachably attached to the metal plate, which will form the second surface of the capsule, for sealing the openings of the metal plate. This metal plate can then be attached to a base element, wherein a circumferential part of the metal plate can be folded such that a circumferential edge is formed, which encloses and holds the base element. Before this step of attaching the thus formed cap element to the base element or after this attaching step, the first sealing element can be detachably attached to the first surface of the base element, in order to provide a capsule with openings on the first and second surfaces, which are airtightly sealed by the first and second sealing elements, respectively. The metal plate is preferentially an aluminum plate.

The water pipe heads described above with reference to FIGS. 1 to 42 can be produced with relatively low costs, preferentially comprise biodegradable components, are relatively easily manufacturable, have good printing possibilities and can airtightly be fitted on a modern adapter as well as a Syrian adapter.

Although in the above described embodiments certain dimensions like diameters, thicknesses, et cetera, certain materials like aluminum, silicone rubber, et cetera, certain shapes and other details are mentioned, the water pipe head can also have other characteristics, for example, other dimensions or can be comprised of other materials. For instance, the thickness of the upper side of the capsule can be 20 percent smaller than shown in the figures. Moreover, the top diameter of the water pipe head as shown in the figures can be reduced, for instance, by 5 mm.

Figure 44:
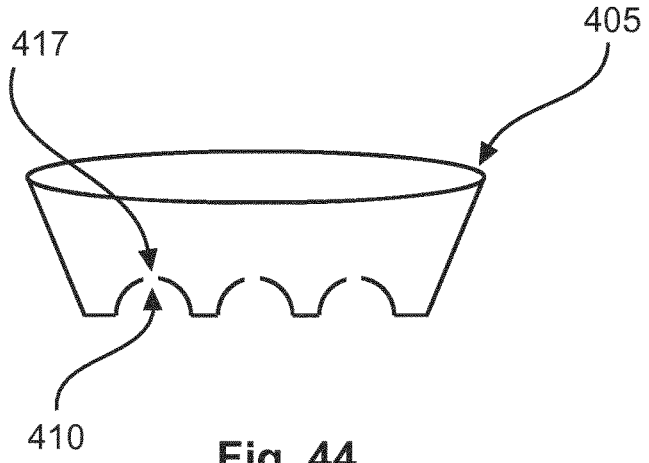
FIGS. 44 to 46 show schematically and exemplarily further embodiments of the base element of the capsule.
Figure 45:
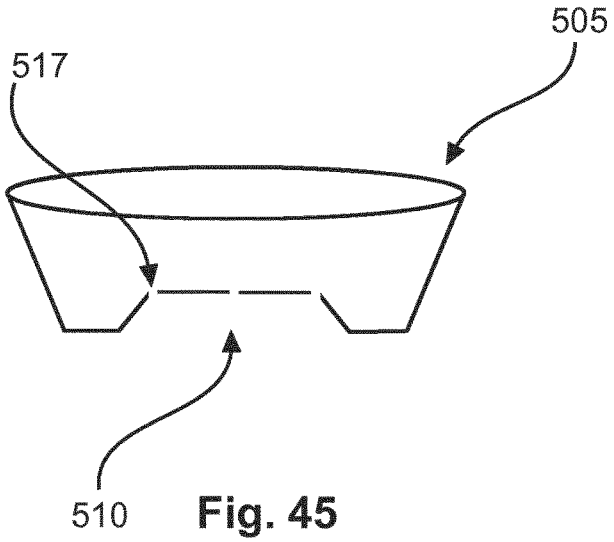
Figure 46:
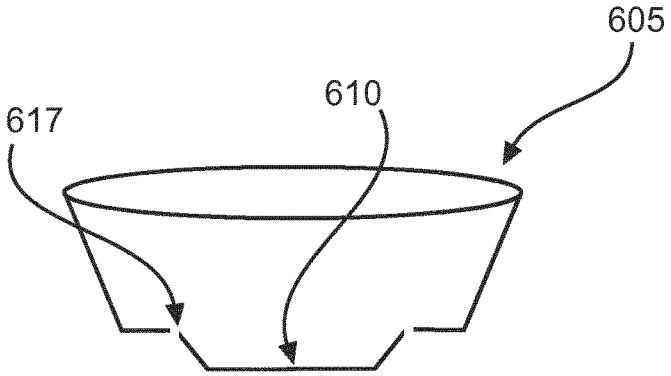

Although in above described embodiments the base element of the capsule has a substantially planar lower surface, in other embodiments the base element can also comprise one or several indentations as schematically and exemplarily shown in FIGS. 44 to 46.

FIGS. 44 to 46 show virtual projection views, i.e., for instance, in FIG. 44 the base element 405 comprises six indentations 410, each comprising an opening 417 in an upper portion of the surface deformed by the respective indentation 410, wherein in the virtual projection view the indentations 410 with the openings 417, which are arranged in a ring, are arranged along a line. The indentations 410 with the openings 417 are arranged in a ring, which corresponds to the ring of openings 17 shown in FIG. 9. FIG. 44 shows therefore an embodiment with upward indentations comprising holes.

The embodiment 505 of the base element schematically and exemplarily shown in FIG. 45 comprises a central indentation 510, wherein the thereby defined central upper portion of the bottom surface comprises openings 517, which are also arranged along a ring similar to the openings 17 shown in FIG. 9. The central indentation 510 has a radius, which is similar to the radius of the ring formed by the openings 517. The embodiment 505 comprises therefore an upward indentation to the entire surface enclosed by and comprising the openings 517.

The embodiment 605 of the base element schematically and exemplarily shown in FIG. 46 comprises also an indentation 610 in the bottom surface, wherein in this embodiment the indentation 610 is a circular central downward indentation, which defines a circumferential upper portion and a central lower portion of the bottom surface of the base element 605, wherein openings 617 are located in the upper circumferential portion adjacent to the central indentation 610. Also the openings 617 are preferentially arranged in a ring, which is similar to the ring of openings 17 shown in FIG. 9. The base elements 405, 505, 605 shown in FIGS. 44 to 46 can be used instead of the base element 5 shown in, for example, FIG. 3.

If the cap element and the base element are pressed together, a circumferential edge of the cap element can enclose the base element or a circumferential edge of the base element can enclose the cap element for forming the capsule.

Figure 47:
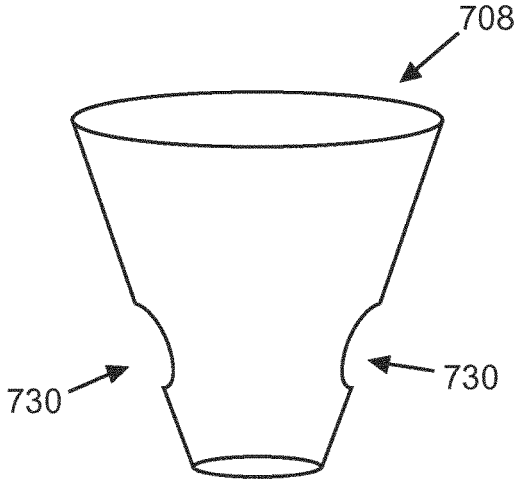
FIG. 47 shows schematically and exemplarily an embodiment of a guiding element with a first kind of grasping element.

In an embodiment, the guiding element can comprise a grasping element for being grasped by a user for facilitating at least one of arranging the water pipe head on and removing the water pipe head from the water pipe. For instance, as schematically and exemplarily illustrated in FIG. 47, the guiding element 708 can comprise outer opposing indentations 730, which can be inward moldings, on two sides of the guiding element 708 being also in this embodiment a paper cone, wherein the indentations 730 oppose each other by 180°. The indentations 730 are preferentially big enough and deep enough for adult fingers to fit into them. They are preferentially placed approximately 35 percent upward from the bottom of the water pipe head, because at this point the temperature may allow the user to touch the water pipe head and sufficient force can be applied when re-attaching the water pipe head onto the water pipe.

Figure 48:
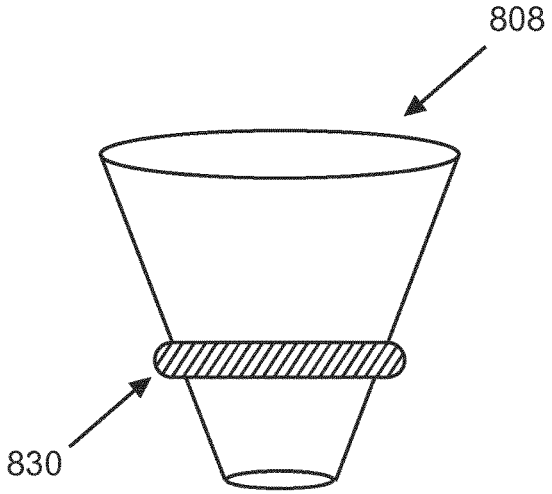
FIG. 48 shows schematically and exemplarily a further embodiment of a guiding element with a second kind of grasping element.

FIG. 48 illustrates schematically and exemplarily another grasping element. In this embodiment the guiding element 808 comprises a rubber rim 830 as the grasping element. In particular, the rubber rim 830 is applied onto a paper cone being, also in this embodiment, the guiding element. The rubber rim goes preferentially 360° around the guiding element. Also in this embodiment the position of the grasping element 830 is preferentially approximately 35 percent upward from the bottom of the water pipe head. The rubber rim 830 is preferentially sufficiently big and robust for adult fingers and for applying sufficient force when attaching the water pipe head to the water pipe.

Figure 49:
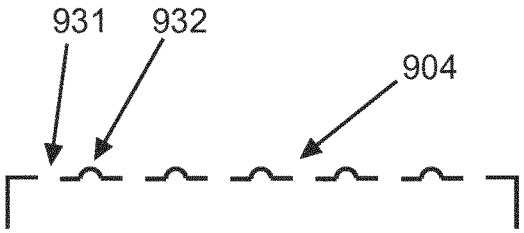
FIG. 49 shows a cross-sectional view of an upper part of a capsule.
Figure 50:
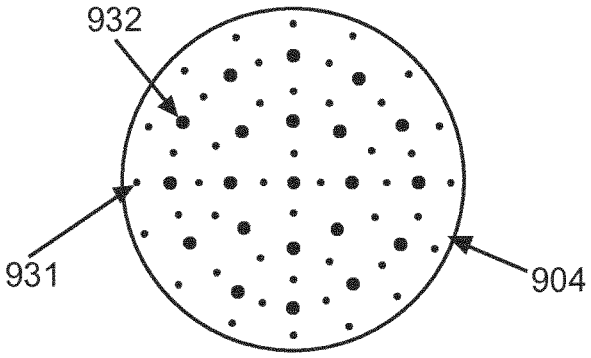
FIG. 50 shows a top view on the upper part of the capsule.

The second surface of the capsule can comprise a three-dimensional structure as schematically and exemplarily illustrated in FIGS. 49 and 50. FIG. 49 shows schematically and exemplarily a cross-sectional view of the upper part of the capsule being preferentially formed by a cap element. FIG. 50 shows schematically and exemplarily a top view on the second surface of the capsule. The capsule 904 comprises upward indentations 932, which may have a height of about 1 mm and a width of about 1 mm. Between the indentations 932 preferentially openings 931 are provided. In this embodiment, the second surface 904 comprises about 50 indentations and about 70 openings. The upward indentations 932, which may also be regarded as being a kind of goose bumps, are preferentially spread over the second surface 904, alternating with the openings 931. The distance between each pair of adjacent upward indentations 932 is preferentially equal to or smaller than 10 mm.

The upper part of the capsule can therefore be formed by a metal foil, in particular, an aluminum foil, which comprises a three-dimensional structure, in order to allow a little bit of air to circulate between the capsule and a heating element like charcoal on the capsule. In order to hermetically seal the capsule despite of the three-dimensional structure on the second surface, the second sealing element is preferentially at least detachably attached to an outer flat circumferential region of the second surface of the capsule such that the openings 931 are hermetically sealed from the surrounding.

The outer side of the capsule may comprise a screw-type fitting like the screw-type fitting of a light bulb or it may comprise another kind of fitting like a bayonet-type fitting. This fitting is preferentially adapted such that the capsule can be inserted into the guiding element, in particular, into the paper cone, with a turn of maximally 180°.

The guiding element can be made of a material that is at least one of heat resistant, reusable, washable in a commercial dishwasher and brandable, i.e. printable.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention relates to a water pipe head comprising a capsule including smokable material, a first sealing element being detachably attached to a first surface of the capsule and a second sealing element being detachably attached to a second surface of the capsule for sealing the capsule, a guiding element having a first opening in which the capsule is held, an opposing second opening and an intermediate passage connecting the first opening and the second opening, and a longish element being attached to the first sealing element and extending from the first sealing element through the intermediate passage and through the second opening to the outside of the guiding element.

The invention claimed is:

1. A water pipe head comprising:

a capsule including smokable material and having a first surface with openings, which is directed towards a guiding element for guiding smoke from the capsule to a water pipe, and an opposing second surface with openings, which is directed away from the guiding element, for generating smoke, a first sealing element being detachably attached to the first surface of the capsule for sealing the openings of the first surface and a second sealing element being detachably attached to the second surface of the capsule for sealing the openings of the second surface, the guiding element having a first opening in which the capsule is held, an opposing second opening and an intermediate passage connecting the first opening and the second opening, wherein the capsule is held in the first opening such that the generated smoke is guidable from the capsule through the first opening, the intermediate passage and the second opening into the water pipe, an extending element being attached to the first sealing element and extending from the first sealing element through the intermediate passage and through the second opening to the outside of the guiding element.

2. The water pipe head as defined in claim 1, wherein the capsule comprises a base element with the first surface and a cap element with the second surface arranged on the base element.

3. The water pipe head as defined in claim 2, wherein at least one of the base element and the cap element is a metal element.

4. The water pipe head as defined in claim 1, wherein the density of openings of the second surface is smaller in an outer region of the second surface than in an inner region of the second surface.

5. The water pipe head as defined in claim 1, wherein the openings of the first surface form a ring.

6. The water pipe head as defined in claim 5, wherein the radius of the ring is larger than the radius of the second opening of the guiding element.

7. The water pipe head as defined in claim 1, wherein the first surface comprises at least one indentation such that the first surface comprises at least one upper portion and at least one lower portion, wherein at least one of the openings is located at an upper portion of the first surface.

8. The water pipe head as defined in claim 1, wherein the first sealing element and the extending element are integrated and form a single element.

9. The water pipe head as defined in claim 1, wherein the guiding element is conically shaped, wherein the first opening is larger than the second opening.

10. The water pipe head as defined in claim 1, wherein the guiding element comprises paper material.

11. The water pipe head as defined 1, wherein the guiding element comprises at its second opening a holding element for holding the guiding element on the water pipe.

12. The water piper head as defined in claim 10, wherein edges of the second opening of the guiding element are folded for forming a holding element for holding the guiding element on the water pipe.

13. The water pipe head as defined in claim 12, wherein the holding element comprises at least one of a rubber bush, a metal ring and a dual cone.

14. The water pipe head as defined in claim 1, wherein the guiding element comprises a grasping element for being grasped by a user for facilitating at least one of arranging the water pipe head on and removing the water pipe head from the water pipe.

15. The water pipe head as defined in claim 14, wherein the grasping element is formed by at least one of an indentation, a groove, a rim and a ring enclosing the guiding element.

16. The water pipe head as defined in claim 1, wherein the second surface of the capsule comprise a three-dimensional structure.

17. The water pipe head as defined in claim 16, wherein the three-dimensional structure is formed by indentations in the capsule.

18. A water pipe comprising a water pipe head as defined in claim 1.

19. A manufacturing method for manufacturing a water pipe head as defined in claim 1, the manufacturing method comprising:

providing a capsule including smokable material and having a first surface with openings to be directed towards a guiding element for guiding smoke from the capsule to a water pipe and an opposing second surface with openings to be directed away from the guiding element for generating smoke, wherein a first sealing element is detachably attached to the first surface of the capsule for sealing the openings of the first surface and a second sealing element is detachably attached to the second surface of the capsule for sealing the openings of the second surface, wherein an extending element is attached to and extends from the first sealing element, attaching the capsule with the first and second sealing elements to the guiding element, which comprises a first opening in which the capsule is to be held, an opposing second opening and an intermediate passage connecting the first opening and the second opening, such that the capsule is held in the first opening of the guiding element for guiding the generated smoke from the capsule through the first opening, the intermediate passage and the second opening into the water pipe, wherein the extending element of the first sealing element extends from the first sealing element through the intermediate passage and through the second opening to the outside of the guiding element.

* * * * *